US005340103A

United States Patent [19]

Kirby et al.

[11] Patent Number: 5,340,103

[45] Date of Patent: * Aug. 23, 1994

[54] COLLAPSIBLE GOLF FAIRWAY DISTANCE MARKER

[75] Inventors: Jack E. Kirby, 8012 River Pl., Carmel, Calif. 93923; Lyle F. Shabram, Jr., Salinas, Calif.

[73] Assignee: Jack E. Kirby, Carmel, Calif.

[ * ] Notice: The portion of the term of this patent subsequent to Jun. 15, 2010 has been disclaimed.

[21] Appl. No.: 987,115

[22] Filed: Dec. 3, 1992

Related U.S. Application Data

[63] Continuation-in-part of Ser. No. 772,566, Oct. 7, 1991, Pat. No. 5,219,171.

[51] Int. Cl.[5] ..... A63B 57/00

[52] U.S. Cl. ..... 273/32 H; 273/32 R; 404/11

[58] Field of Search ..... 273/32 H, 32 R, 176, 273/34 R; 40/609, 610, 217, 124.5; 116/209, 222; 404/10, 11, 13, 9; 52/101, 103

[56] References Cited

U.S. PATENT DOCUMENTS

| | | | |
|---|---|---|---|
| 1,410,007 | 3/1922 | Down | 404/11 |
| 1,771,667 | 7/1930 | Vogler | 404/11 |
| 2,073,968 | 3/1937 | Krebs | 404/11 |
| 3,599,981 | 8/1971 | Zausmer | 273/176 A |
| 4,108,439 | 8/1978 | McGuire | 273/176 R |
| 4,302,125 | 11/1981 | Cullen | 404/9 |
| 4,489,669 | 12/1984 | Carmen | 116/202 |
| 5,192,159 | 5/1993 | Higginson | 404/11 |
| 5,219,171 | 6/1993 | Kirby et al. | 273/32 H |

*Primary Examiner*—Mark S. Graham
*Attorney, Agent, or Firm*—Claude A. S. Hamrick

[57] ABSTRACT

A collapsible golf fairway distance marker including a visible structure that can assume two discrete configurations, and an anchor structure. The visible structure is generally cone-shaped when raised and flat when collapsed and is comprised of a base support ring, a spring-loaded plunger assembly disposed in the center thereof, and a plurality of generally trapezoidal shaped leaves. Each leaf has its narrower end captured within an annular recess formed between the plunger top and a cap screwed into the plunger, while its wider end is captured within an annular recess formed in the base support ring. Numerals indicating distance are affixed to or embossed in an upper part of one or more leaves. The anchor structure is connected to the base support ring and is buried beneath the ground to provide a fixed location for the visible structure on the fairway. An annular skirt affixed to and surrounding the base support ring extends the footprint of the marker and prevents grass from growing so near as to interfere with the visibility of the marker.

22 Claims, 11 Drawing Sheets

COLLAPSIBLE GOLF FAIRWAY DISTANCE MARKER

CROSS-REFERENCE TO RELATED APPLICATIONS

This application is a continuation-in-part of U.S. patent application Ser. No. 07/772,566 (filed Oct. 7, 1991, U.S. Pat. No. 5,219,171) entitled "Collapsible Golf Fairway Distance Marker", assigned to the assignee of the present invention.

BACKGROUND OF THE INVENTION

1. Field of the Invention

The present invention relates generally to devices that assist in the play of golf, and more particularly, to a distance-indicating device for allowing golf players to make a quick estimate of the distance between their ball position on the fairway and the center of the green.

2. Brief Description of the Prior Art

For the purpose of making it easier to select the proper golf club and speeding up the play on a golf course, distance markers are placed on course fairways. Distance markers provide players a quick estimate of the distance between the ball's position on the fairway and the center of the green. It is common for these markers to be permanently fixed to the ground so that they can not be easily moved. Some golf courses use sprinkler heads as distance markers. This method of distance marking is useful since each fairway is equipped with numerous sprinkler heads and such heads remain at fixed positions.

A major problem that exists with such markers is that they rise above ground level and interfere with maintenance operations conducted on the fairways (e.g. grass cutting). These devices must either be removed prior to grass cutting or must be avoided by the mowers. In either case the maintenance operations are impeded. In the first instance, the mowing operation is slowed down by the constant removal and reinstallation of the markers. In the second instance, the grass cutting around the markers cannot be done by large-scale cutters without damaging the markers. Thus, alternative cutting mechanisms must be employed to cut the grass.

One prior art solution to this problem is to have markers that are level with respect to the surrounding ground so as not to impede these fairway maintenance operations. The teaching of Zausmer (U.S. Pat. No. 3,599,981) is an example of such a marker. In Zausmer, the marker is comprised of a base plate and a top plate. The base plate has a plurality of pins having cone-shaped barbs on the ends, and numerals raised upwards from the base. The barbs anchor the base plate permanently into the fairway turf. The raised numerals indicate the applicable fairway distance. The top plate is attached to the base plate, and features a cutout that frames the numerals rising up from the base plate. Markers of this type fail to provide easily visible information to golfers during the course of play. The numerals on such a marker are virtually invisible to a golfer standing any distance away from the marker. The numerals would only be visible if the golfer were standing overhead or virtually next to the marker. Thus, in many cases the golfer will not see the marker and therefore will not be assisted in calculating the distance from his ball to the green.

Another prior art solution provides markers with elastically deformable visible elements rising above the level of the surrounding fairway turf, which are not damaged even when run over by fairway maintenance equipment. The teaching of Carman (U.S. Pat. No. 4,489,669) is an example of such a marker. Carman's marker comprises an elastic dome connected to a base. The dome extends upward from the base, rises above ground level, and may be inscribed with numerals to indicate range distances along the fairway. Although a golfer does not have to stand over the element to read the distance, as in the Zausmer teaching, because of the curved surface the distance at which the inscribed numerals are visible is still quite limited.

A significant shortcoming of the Carman-type markers is that its visible element deforms rather than collapses out of the way of potentially damaging devices. When the element encounters a sufficient pressure only the localized area in contact with the force deforms: a simultaneous collapse of the entire element does not occur. Areas that are not exposed to such sufficient pressure remain elevated above the ground and may be damaged by the oncoming mower device.

Another signal or marker found in the prior art, although not specifically utilized on golf fairways as a yardage marker, is disclosed by Vogeler (U.S. Pat. No. 1,771,667). Vogeler's ancient marker device, installed in a roadway and used as a traffic signal, includes a casing, a resiliently biased post centrally disposed within the casing and mounted thereto to slide vertically, a plurality of segments with their upper ends hingedly supported at the upper end of the post and with the segment's lower end slidably mounted within the casing.

In operation, the marker is installed at traffic intersections, and its segments, elevated above the road surface, are inscribed with cautionary words (i.e. "STOP", "GO", etc). If a motor vehicle is driven over the marker, the vehicle weight will cause the several segments to move downwardly thereby imparting a downward motion, via the post, to all of the remaining segments. Once the vehicle weight is removed, the spring-biased post will restore the segments to their respective normal positions.

If the Vogeler marker was installed on a golf fairway it would be quickly rendered inoperable. More specifically, the Vogeler marker's segments are hinged at their upper ends and slidably mounted at their lower ends. Due to the slidably mounted support configuration, the marker has gaps or openings existing between adjacent segments at their lower ends. Since these gaps would be located close to the fairway surface, grass clippings and other fairway debris could easily invade the marker, through the gaps, such that over a period of several grass cutting sessions, the clippings and debris would accumulate and block the lower segment ends from freely sliding, thereby impeding both the collapsibility of the marker and its return to an upstanding position. It should be noted that, in contrast to the lower end of the segments, clippings and debris can not enter between the upper end, hinged joints and impede the collapsibility of the marker because, due to the hinged manner of support, there are no gaps between the adjacent segments at their upper ends.

Finally, the prior art discloses using a system of determining the distance from a point on the fairway to its associated green. KARSTEN PING discloses a system wherein a plurality of yardage markers are disposed at twenty-five yard intervals along the fairway. Each marker, set at ground level, displays the distance from its location on the fairway to various points on the green. Since the markers used in the KARSTEN PING system are set at ground level they have the same shortcomings as those identified with the Zausmer markers. That is, markers of this type can only be read by golfers standing overhead or virtually next to the marker. Golfers positioned any distance away from the marker cannot read the range information stamped on the marker and in many cases cannot even see the marker itself. Thus, a system utilizing such flat markers cannot assist the golfer in calculating the distance from his ball to the green.

SUMMARY OF THE PRESENT INVENTION

It is therefore an object of the present invention to provide a golf fairway distance marker with a numeral-bearing element that rises to a pre-determined height above the adjacent turf, and is visible from a distance and from any viewing angle on the fairway.

Another object of the present invention is to provide a golf fairway marker having means for avoiding damaging contact with the cutting cylinders of a typical fairway mower by having it collapse level with or below the surrounding fairway turf when any portion of its surface is subjected to compressive forces approaching from any direction.

Still another object of the present invention is to provide a marker of the type described having means for automatically restoring the collapsed element to its non-collapsed configuration after the collapse-causing forces have been withdrawn from its surface.

Yet another object of the present invention is to provide a marker of the type described having means for preventing the intrusion of fairway debris into the operative mechanism of the marker.

A further object of the present invention is to provide a golf fairway distance marking system including a plurality of markers, of the type described, placed at regular intervals along the fairway such that a golfer may view or read at least one marker from almost any random position on the fairway or adjacent rough.

Briefly, a preferred embodiment of the present invention includes a visible structure that can assume two discrete configurations, and an anchor structure. The visible structure is generally cone-shaped when raised and flat when collapsed, and is comprised of a base support ring, a spring-loaded plunger assembly disposed in the center thereof, and a plurality of generally trapezoidal shaped leaves. Each leaf has its narrower end captured within an annular recess formed between the plunger top and a cap screwed into the plunger, while its wider end is captured within an annular recess formed in the base support ring. Numerals indicating distance are affixed to or embossed in an upper part of one or more leaves. The anchor structure is connected to the base support ring and is buried beneath the ground to provide a fixed location for the visible structure on the fairway.

An advantage of the present invention is that it provides a golf fairway distance marker with a distance indicating surface that rises above the surrounding turf level and is visible from a distance and from any viewing angle on the fairway.

Another advantage of the present invention is that when any portion of the surface is contacted by sufficiently large compressive forces approaching from any direction, it will collapse into a configuration in which it is level with or below the surrounding fairway turf thereby avoiding damaging contact with the cutting cylinders of a typical fairway mower.

Another advantage of the present invention is that once the forces have subsided from all portions of the element, it automatically restores itself to its raised configuration.

Another advantage of the present invention is that the leaves are hinged in such a manner so as to block fairway debris from entering the marker and impeding its operation.

An advantage of the systematic placement of markers at regular intervals along the fairway is that at least one of the markers may be viewed by a golfer standing at almost any location on the fairway or adjacent rough.

Yet another advantage of the systematic placement of markers at regular intervals along the fairway is to provide an accurate determination of the distance to the green, thereby facilitating golf club selection and enhancing speed of play along the course.

These and the other objects and advantages of the present invention will no doubt become apparent to those skilled in the art after having read the following detailed description of the preferred embodiment illustrated in the several figures of the drawing.

IN THE DRAWING

DESCRIPTION OF THE PREFERRED EMBODIMENT

Figure 1:
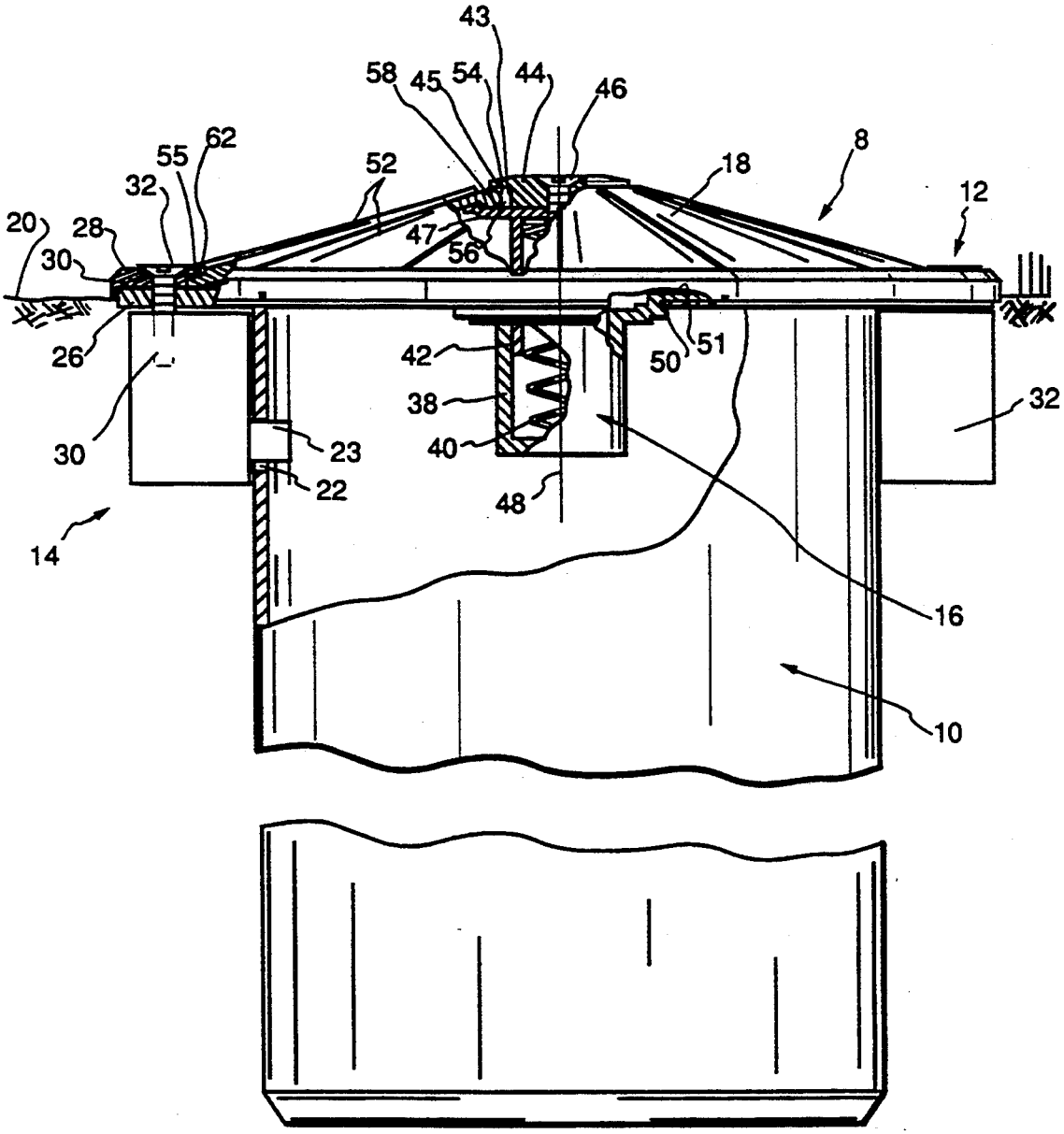
FIG. 1 is a partially broken side view of a collapsible fairway marker in accordance with the present invention.

Referring to FIG. 1 of the drawing, a preferred embodiment of an improved collapsible golf fairway distance marker in accordance with the present invention is shown. A marker 8 is comprised of an anchor assembly 10, a base support assembly 12, a marker attachment device 14. a central riser assembly 16, and a wedge assembly 18.

The anchor assembly 10 is entirely disposed beneath the fairway turf 20 and secures the marker to a fixed position on the fairway. The anchor assembly is cylindrical in shape, with a number of fastening holes 22 drilled through its wall at one end of the cylinder.

The base support assembly 12 rests on top of the anchor assembly 10 substantially level with the fairway turf 20 and is comprised of a base plate 26 and a clamp ring 28. The base plate fits within the clamp ring, with the outer periphery of the base plate fitting within a shoulder skirt 30 formed in the clamp ring. The base plate and the clamp ring are joined by a plurality of screws 32.

The marker attachment devices 14 secure the base support assembly 12 to the anchor assembly 10. These devices include the screws 32 mentioned previously, and a plurality of block fasteners 34. A peg 23, mounted to a side surface of the block fastener, passes through a hole 22. The screws 32 pass through openings provided in the clamp ring 28 and the base plate 26 and into holes 36 tapped into the upper surface of the block fastener 34.

The central riser assembly 16 is disposed partially above and partially below ground level. It consists of a housing 38, a spring 40, a plunger 42, a disc cap 44, and a cap screw 46. Housing 38 is located in a hole formed in the center of base plate 26 such that the housing's longitudinal axis 48 runs through the center of the hole. Housing 38 has a circumscribing upper flange 50 that rests upon an internal shoulder 51 formed in base plate 26 surrounding the central opening. The spring 40 and plunger 42 are coaxially disposed relative to housing 38 with plunger 42 being telescopically slidable into housing 38. Spring 40 resiliently biases plunger 42 toward its upper position illustrated. The disc cap 44 sits on the upper end of plunger 42, and the screw 46 attaches the cap to the plunger.

The wedge assembly 18 is comprised of a plurality of generally trapezoidal shaped leaves 52, the upper ends 54 of which are captured between a radially extending flanged portion 45 of cap 44 and a shoulder portion 47 extending radially outwardly from the top of plunger 42. The lower ends 55 of leaves 52 are captured between base plate 26 and an inwardly extending flange 57 formed around the inner perimeter of ring 28. Alternatively stated, the narrower upper ends 54 of the leaves 52 are contained within an annular cavity 56 formed by the disc cap 44 and the plunger 42. Note that a substantial clearance is provided between the ends 54 and the cylindrical cap surface 43. The ends 54 have a downturned lip 58 that hooks over the rim 47 surrounding the plunger top creating a definite upper limit stop for the wedge assembly. This hook and rim engagement of the leaf with the plunger 42 causes the plunger to remain squarely positioned within housing 38 and poised for downward vertical movement. The base or lower end 55 of each leaf 52 rests within an annular recess 59 formed by the base plate 26 and the inner perimeter of clamp ring 28. Each leaf base has an up-turned lip 62 that wraps around and interlocks with a mating surface of the clamping ring 28 so that the leaves cannot become disengaged while the wedge assembly is raised.

Figure 2:
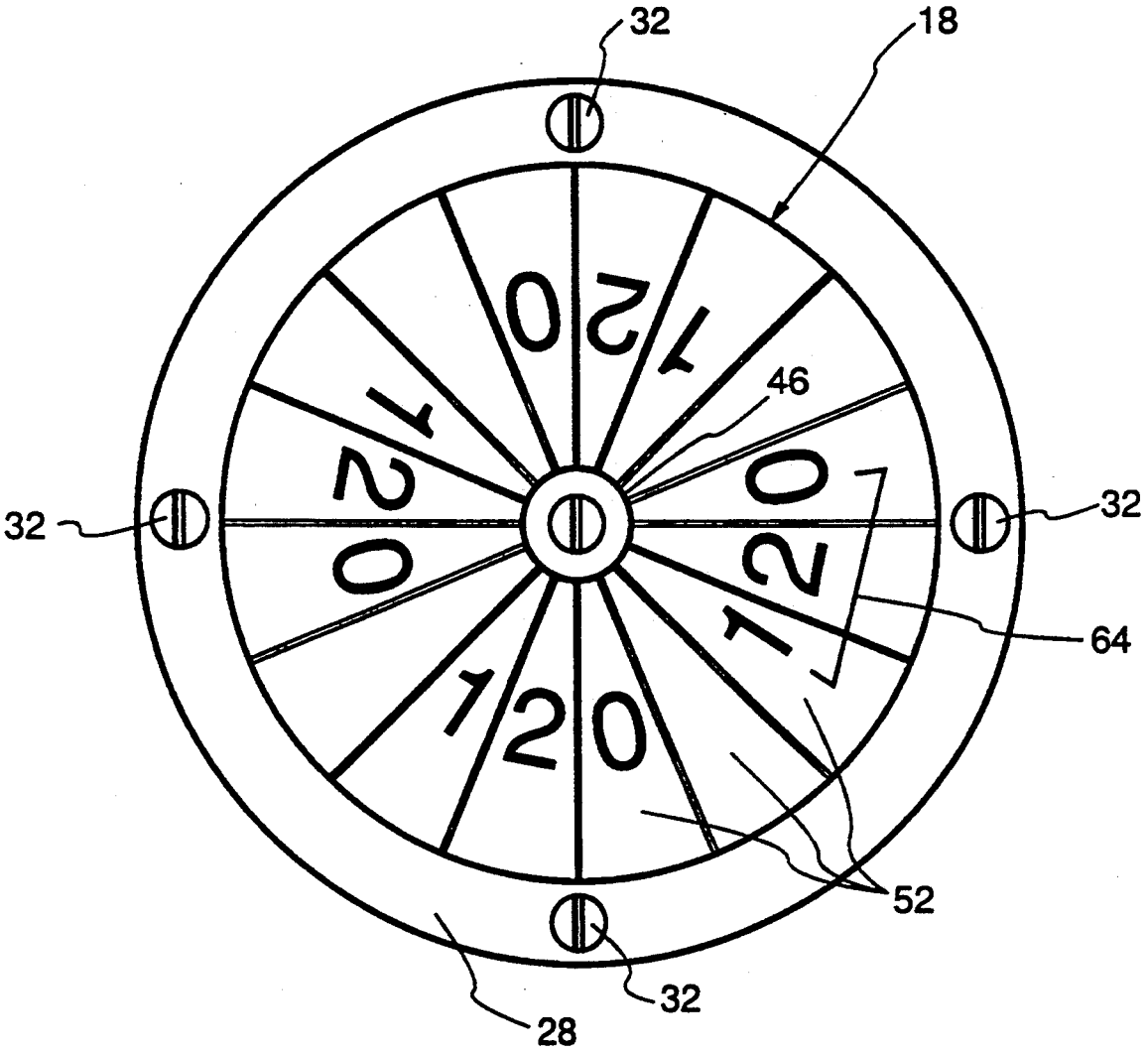
FIG. 2 is a plan view showing additional components of the preferred embodiment.

Referring now to FIG. 2 which depicts a plan view of the marker and in which the arrangement of the leaves 52 will be appreciated. Each leaf 52 is generally trapezoidal in shape, separate, and individually replaceable. Note that some of the leaves are embossed, etched or labelled with numerical impressions 64 that indicate the distance from the marker to a specified location on the associated green.

Figure 3B:
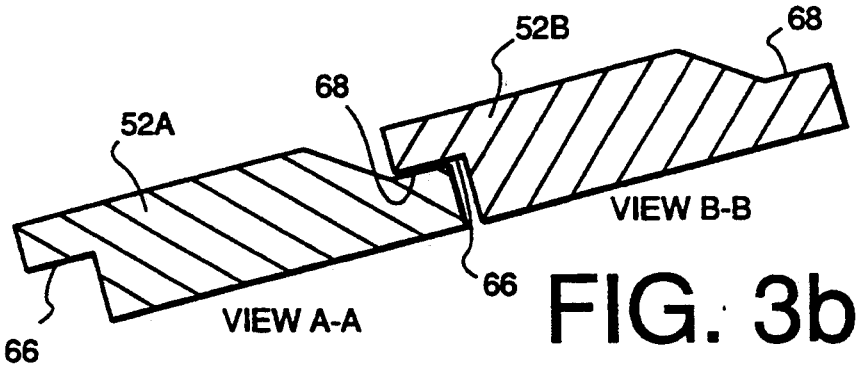
FIGS. 3A and 3B illustrate the interlocking structure of the leaves.
Figure 3A:
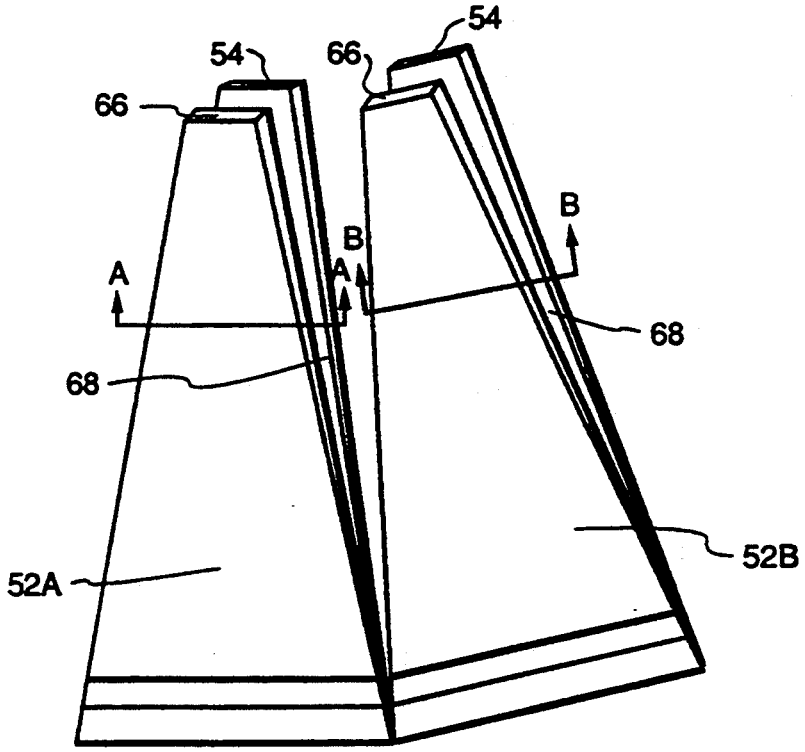

FIGS. 3A and 3B of the drawing depict the interaction and overlap between adjacent leaves of the wedge assembly. FIG. 3A depicts a plan view of two adjacent leaves 52A and 52B juxtaposed but separated from engagement with each other. In this view an overlapping edge projection 66 and a relief ledge 68 associated with each leaf may be seen. As shown in the figure, the ledge 68 is formed along the side and the upper end 54 of each leaf. FIG. 3B depicts a sectional view of the same two adjacent leaves with the overlapping relationship shown. In this view the overlapping edge 66 of the leaf 52B is shown slidably disposed over the relief ledge 68 of the leaf 52A.

Figure 4A:
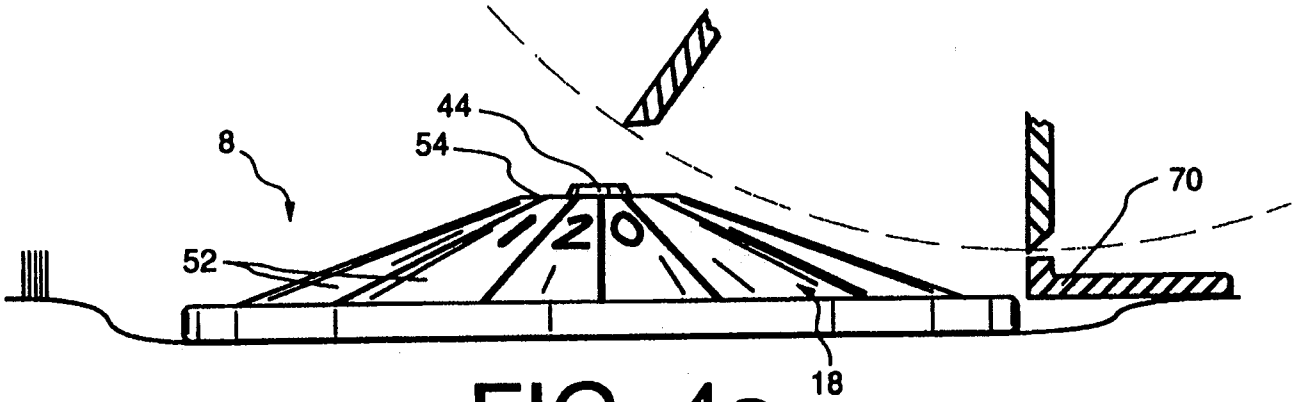
FIGS. 4A and 4B are elevational views respectively showing the marker of FIG. 1 in its raised and collapsed configurations.
Figure 4B:
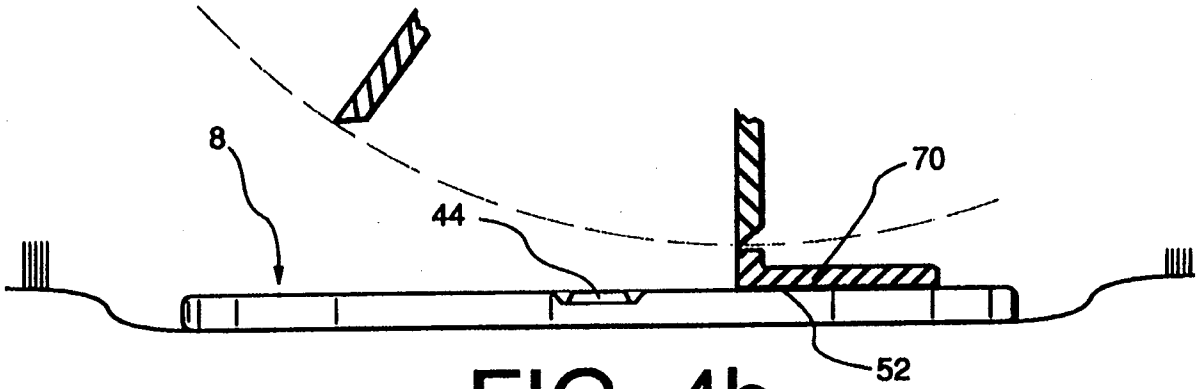

In operation, referring to FIGS. 4A and 4B, the two discrete operational configurations of the marker are shown. In FIG. 4A the marker is shown in its raised configuration with the bed knife 70 of an oncoming mower about to make contact with the wedge assembly 18. As was pointed out above with reference to FIG. 2, the internal spring 40 keeps the plunger 42, and the disc cap 44 in the raised position. The upward action on the plunger also pushes upward on the upper ends of leaves 52 through the lip and rim engagement such that the wedge assembly 18 is caused to extend above the surface of the surrounding fairway turf 20. While in the raised position the upper surfaces of adjacent leaves are slightly separated, but the gaps between adjacent leaf surfaces are not noticeable because the overlapping edge 66 of one leaf is slidably disposed over the relief ledge 68 of the adjacent leaf, thereby covering the gaps. This is a significant feature of the present invention because it ensures that no debris can enter the interior of the marker in either its raised or collapses dispositions.

In FIG. 4B the marker is shown in the collapsed configuration. In this figure, the bed knife 70 has moved into contact with a portion of one or more leaves 52. The forces applied by the knife are transferred through the leaves 52 to the plunger 42, and finally to the spring 40. The knife forces overcome the spring resistance, the spring compresses, and the plunger slides down into the housing, allowing the leaves to rotate downwardly as the leaf bases pivot about their lower extremities. As the leaves pivot, their upper ends 54 converge. The relief ledge 68 formed along the leaf upper end 54 is slidably disposed into the cavity 56 (FIG. 1) provided between the leaf upper end 54 and the cylindrical cap surface 43. As the marker collapses, the overlap ledge 66 of the leaf slides over the relief ledge 68 of its adjacent leaf.

Once the mower has passed, the spring lifts the plunger and in turn rotates the wedge sections upwardly back into their raised configuration.

In some fairway mowers, a set of ground contacting rollers (not shown) are disposed in a position leading the cutting blades. In such mowers, the leading rollers contact the wedge assembly 18, thereby, as discussed above, collapsing the marker. In such mowers, the marker is fully collapsed before the wedge assembly 18 is contacted by the bed knife 70. Thus, the bed knife merely maintains the force onto the leaves necessary to keep the marker in its collapsed configuration.

As indicated above, during operation the gaps between adjacent leaves at the upper portion of the leaves are always closed, and at the lower portion of the leaves there are no such gaps. This is a significant distinction over the prior art marker disclosed by Vogeler in that in the Vogeler marker, the segments (or leaves) are hinged at their upper ends, while being slidably supported at their lower ends. Due to the hinged manner of support, the leaves are closely spaced with no clearances or gaps, at their upper portions. But, because of the slidable support at the lower portion, clearances or gaps exist which can admit debris and interfere with operation of the device. The continuous buildup of debris eventually blocks the motion of the leaves and impedes the collapsibility of the marker.

In contrast, the present invention is designed such that the upper portion of the leaf is slidably engaged within the cavity 56, and the lower portion of the leaf is supported in a hinged manner within the annular recess 59. The clearance, gaps or openings between the upper portions of the leaves are closed by the overlapping ledges 66 and 68 (FIGS. 3A and 3B). Thus, fairway debris is less likely to enter into the marker, cause blockage of the leaf motion and impede the marker's collapsibility.

Figure 5:
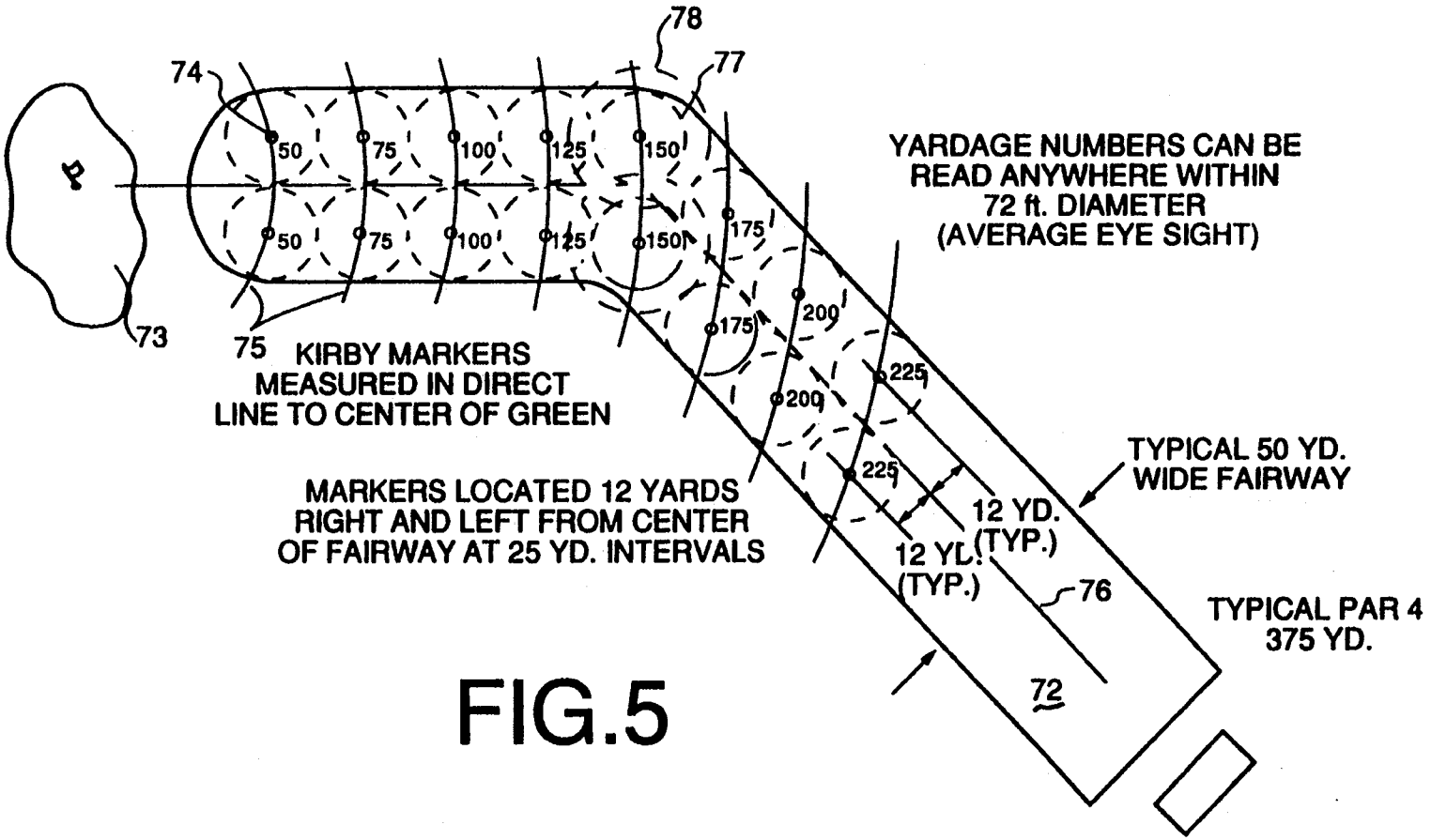
FIG. 5 depicts a system of placing the markers of FIG. 1 at regular intervals along the fairway.

FIG. 5 illustrates a system for quickly determining the distance from any location on the fairway to a specified location on the associated green. More specifically, FIG. 5 depicts a plan view of a typical fairway 72 and green 73. Collapsible markers 74, of the type previously described, are installed at regular intervals (preferably twenty-five yards) along the fairway. Markers are located at specified radial distances, as indicated by the arcs 75, away from the green and are typically placed about twelve yards to the right and about twelve yards to the left of the fairway centerline 76. Depending on the eye level and visual acuity of the player, the maximum range of legibility of the numerals on a marker will vary between approximately 12 and 20 yards, as indicated by the circles 77 and 78, respectively. Nearly all golfers standing at or within a circle 77 will be able to read numerals on the corresponding marker. Thus, as illustrated in FIG. 5, for nearly all golfers at least one marker will be legible when standing almost anywhere on the fairway and nearby rough.

Figure 6:
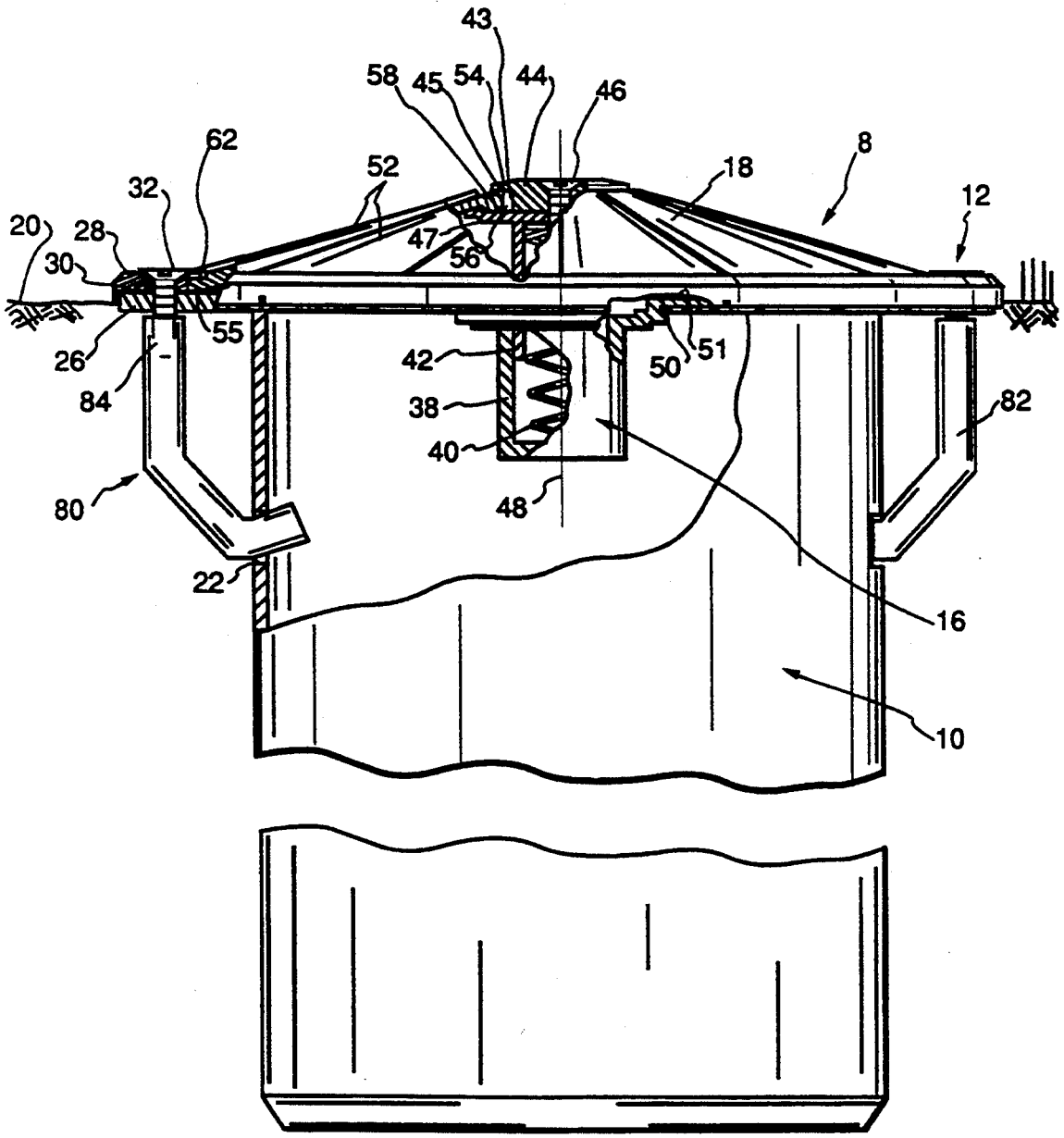
FIG. 6 depicts the present invention with an alternate embodiment of the anchoring device.

Although an improved collapsible golf fairway distance marker attached to a cylindrical structure by a block fastener has been disclosed above it will be appreciated that, in the alternative, another means of attachment may be utilized. Referring now to FIG. 6, the marker attachment devices 80 secure the base support assembly 12 to the anchor assembly 10. These devices include the screws 32 mentioned previously, and a plurality of hook fasteners 82. One end of each hook fastener passes through the hole 22, while the hook's other end is attached to the base plate 26 and the clamp ring 28 by the screws 32. The screws 32 pass through openings provided in the clamp ring 28 and the base plate 26 and into holes 84 tapped into the upper end of the hook fastener 82.

Figure 7:
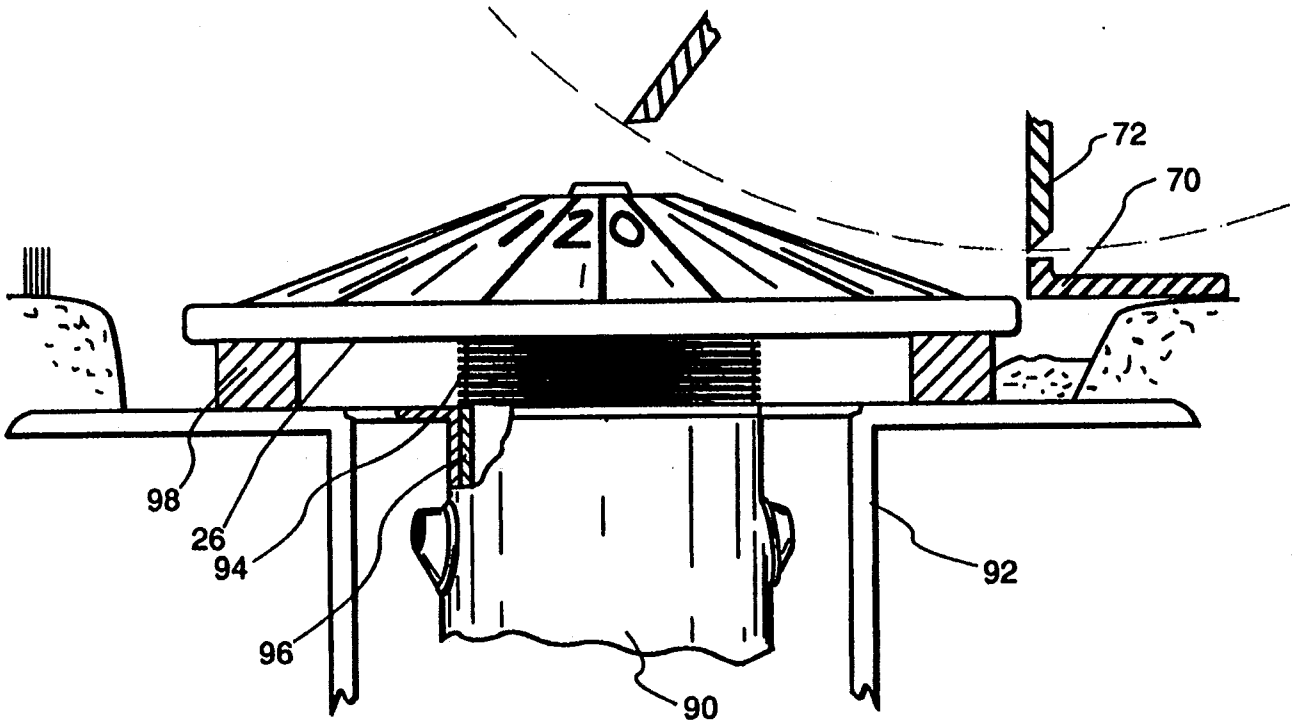
FIG. 7 illustrates an alternate embodiment of the present invention.

As an alternative to anchoring the collapsible golf fail-way distance marker to a cylindrical structure, it will be appreciated that the present invention may be designed to fit on and replace the top of a number of popular sprinkler heads used in golf course fairways. Referring now to FIG. 7, the sprinkler head 90 when in use is lifted by water pressure out of its encasement 92 and retracts into its encasement when the water pressure is shut off. The base support assembly 12 in this embodiment is adapted to replace the cover of the sprinkler head. In this configuration the base plate is fitted with a threaded post 94 that engages a matching threaded insert 96 of the sprinkler head. Since the sprinkler heads may be installed at varying depths below the grass level, height adjustment is accommodated by the threaded post 94. Since raising the height of the device above the sprinkler head may create a gap between the support ring assembly and the encasement 92, it might also be desirable to add a support spacer 98 beneath the base plate 26 to support the outer edges of the mounting base above the sprinkler encasement.

Figure 8A:
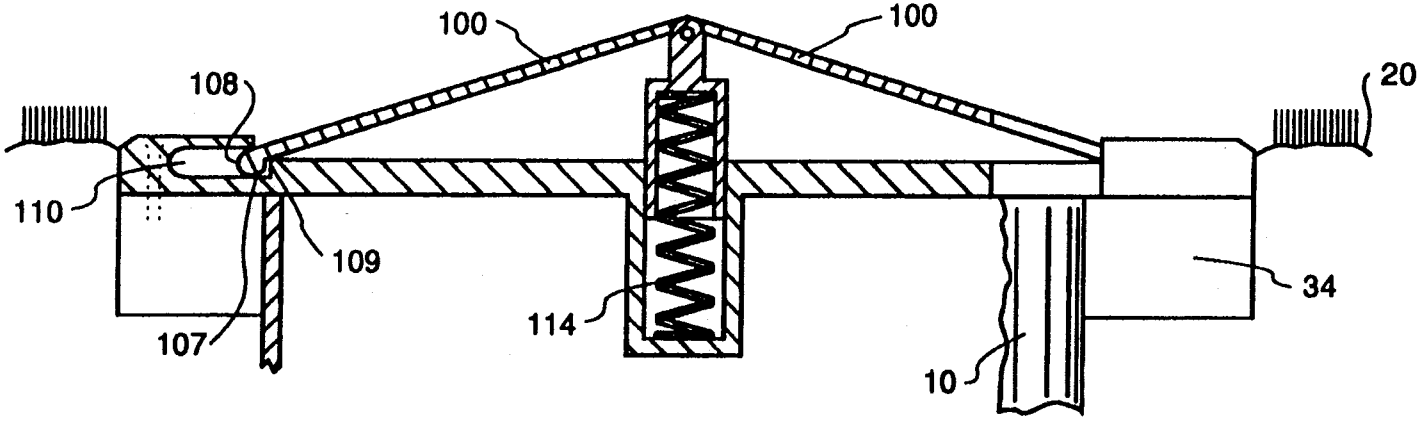
FIGS. 8A and 8B depict another alternate embodiment of the present invention.
Figure 8B:
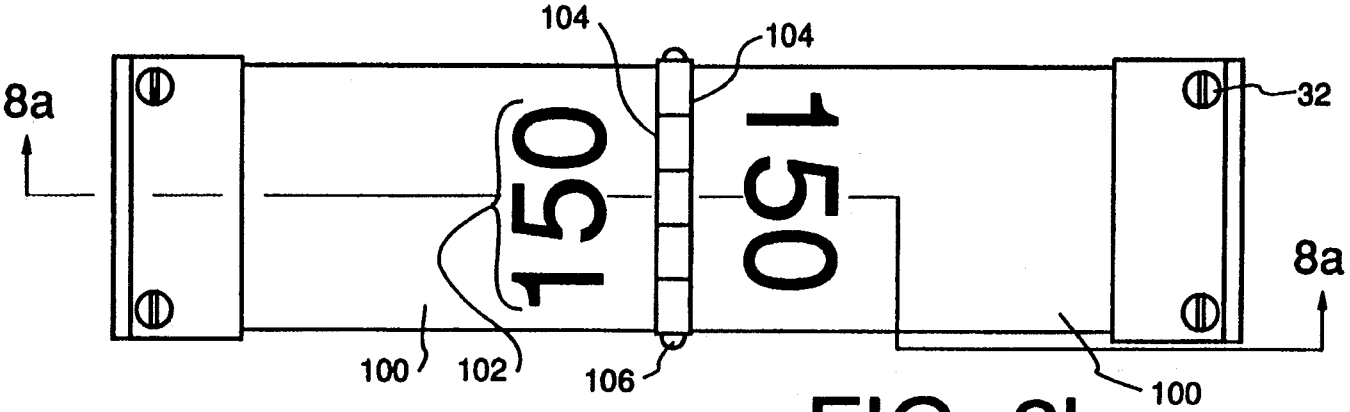

An alternative embodiment of the improved collapsible golf fairway distance marker disclosed above can be implemented in the form of a simpler two-sided collapsible marker. Referring now to FIGS. 8A and 8B, the alternative marker design incorporates two generally rectangular shaped plates 100. The plates are embossed, etched, or labelled with numerical impressions 102 that indicate distance from the marker to a specified location on the associated green. The plates 100 are attached together, at their upper end 104, by a hinge 106. The lower end 108 of the plate is contained within a cavity 110 formed at the end of a generally rectangular shaped base support plate 112. The lower end 108 of the plate has a down turned lip 107 that hooks over a rim 109 formed in the support plate 112. This hook and rim engagement prevents the plate 100 from sliding out of the cavity and also provides a definite upper limit stop as the plates 100 rotate in an upward fashion. As a fairway mower, or similar device, runs over the plates the spring 116 is compressed and the lower end 108 of each plate slides into the cavity 110 thereby collapsing the marker. As the mower passes, the spring lifts and in turn the plates rotate upwardly into their raised configuration.

Figure 9:
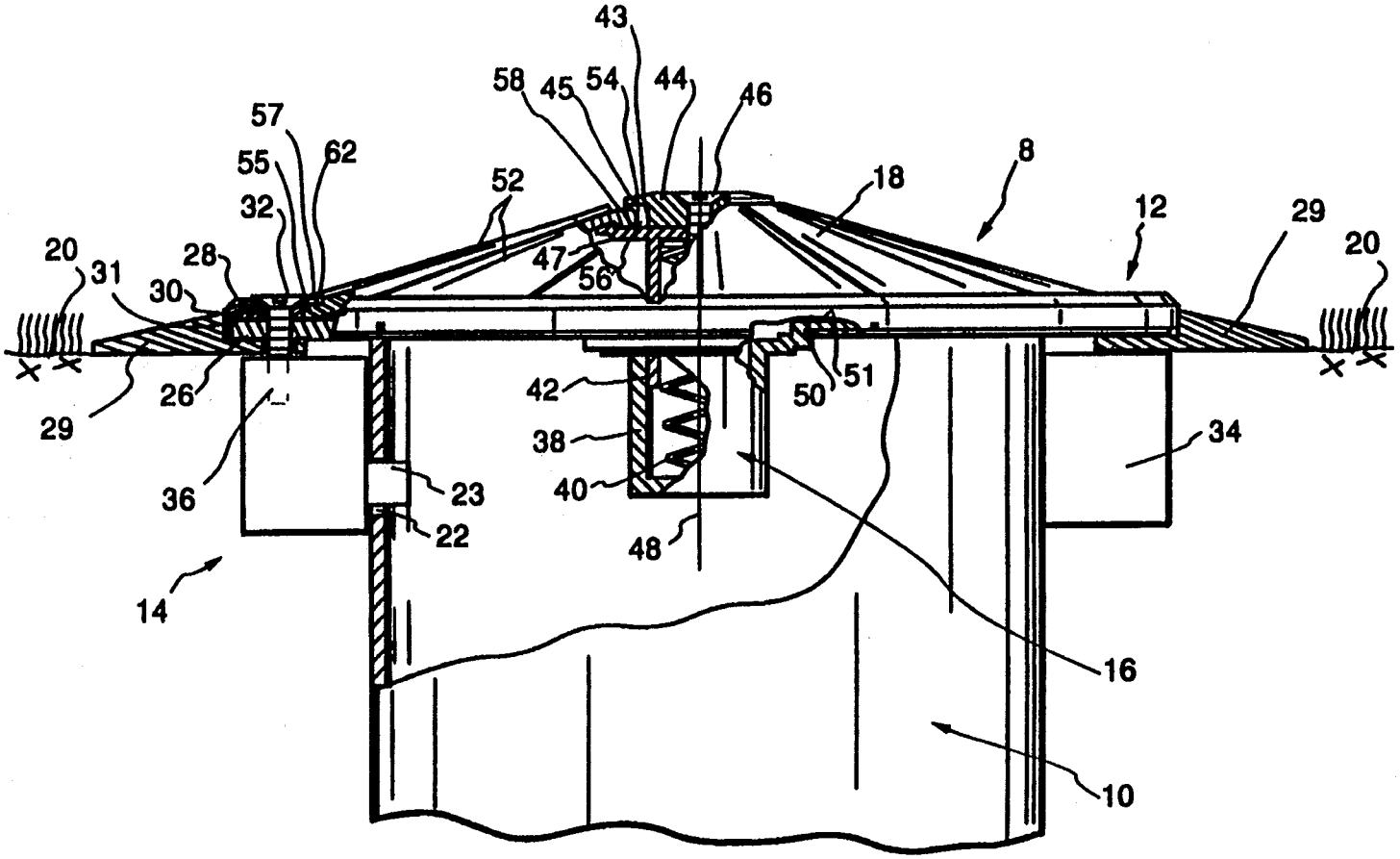
FIG. 9 illustrates another alternative embodiment of the present invention depicted in FIG. 1.
Figure 10:
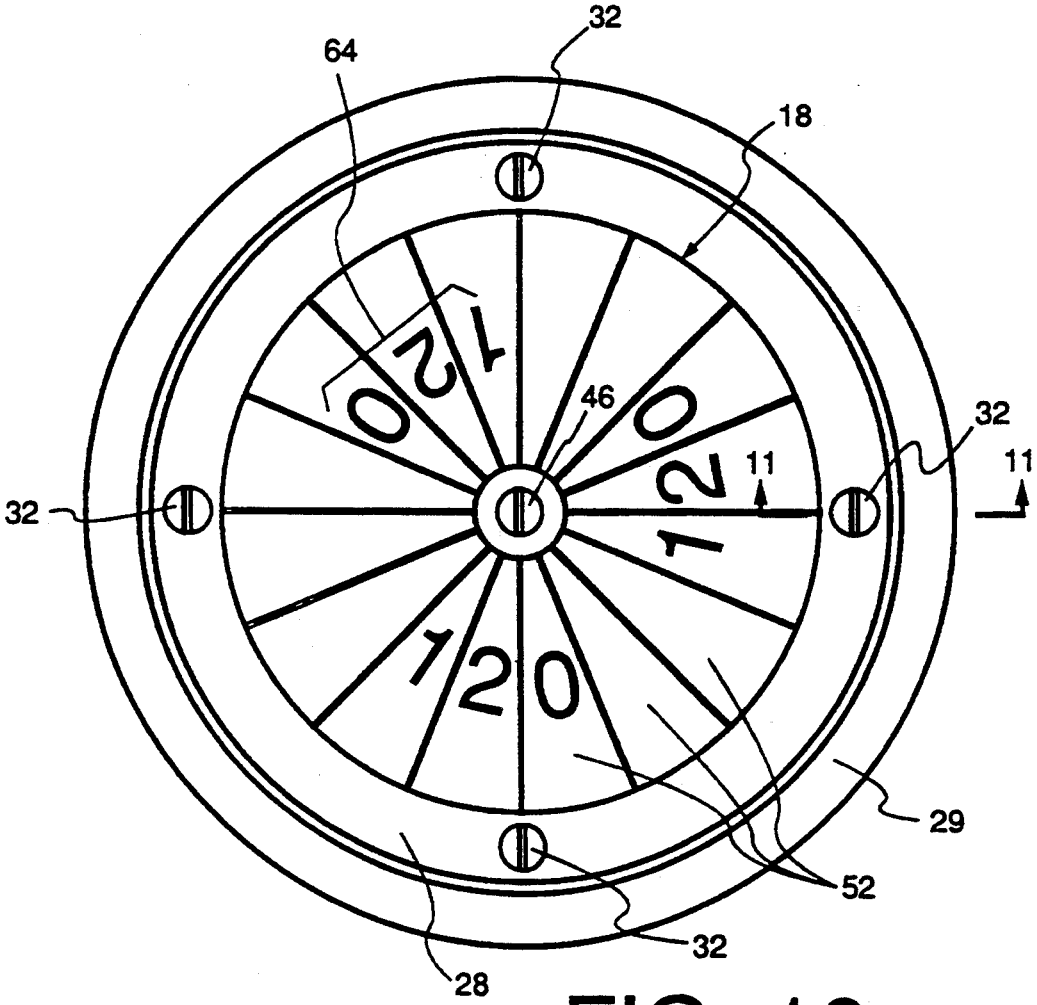
FIG. 10 depicts a plan view of the embodiment illustrated in FIG. 9.
Figure 11:
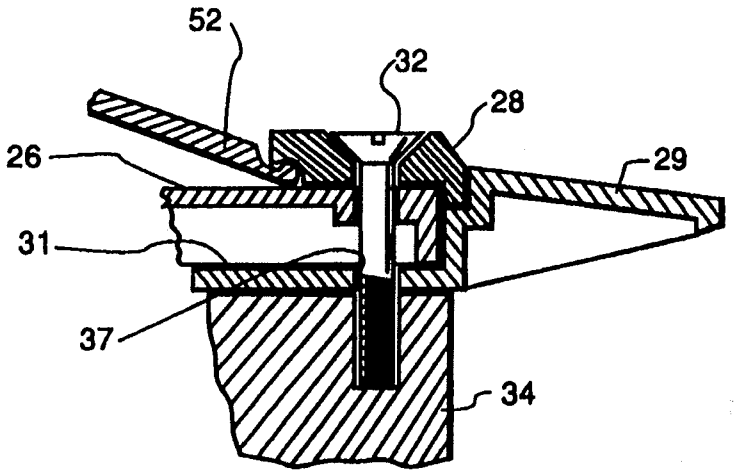
FIG. 11 is a partical cross-section taken along the line 11—11 of FIG. 10.

Referring now to FIGS. 9, 10 and 11, yet another alternative embodiment of the present invention is depicted wherein the marker is generally identical to the marker illustrated in FIG. 1, except that the base support assembly 12, which rests on top of the anchor assembly 10 substantially level with the fairway turf 20, further includes a skirt ring 29 that extends the radial reach of the device and keeps the grass from growing so near the base as to interfere with the full viewing of the marker. As depicted most clearly in FIG. 11, which is a partially broken cross-section taken along the line 11—11 of FIG. 10, the outer periphery of the base plate 26 and clamp ring 28 fit within an annular recess 31 formed in the skirt ring 29. Note that in this embodiment the recessed portion 31 of ring 29 has been positioned in ring 29 in alignment with the screw holes in base 26 and clamp ring 28 to allow screws 32 to pass therethrough and into engagement with block 34.

It will appreciated that visibility of the marker the skirt 29 will be enhanced as a result of the clearance zone provided around the marker per se, by the skirt ring 29. Grass growth is set back from the marker, such that the potential problem of fairway overgrowth obscuring the visibility of the marker is minimized.

Although preferred and alternative embodiments of the present invention have been disclosed above, it will be appreciated that numerous alterations and modifications thereof will no doubt become apparent to those skilled in the art after having read the above disclosures. It is therefore intended that the following claims be interpreted as covering all such alterations and modifications as fall within the true spirit and scope of the invention.

What is claimed is:

1. An improved golf fairway distance marker comprising:

anchor means;

base support means having a circular outer perimeter;

fastening means for securing said anchor means to said support means;

means forming a central riser disposed in the center of said base support means and movable between an upper position and a lower position and including means resiliently biasing said riser in the direction toward the upper position;

a plurality of elongated plates each having one extremity pivotally engaging said base support means and an opposite extremity pivotally engaging said central riser, such that, when said riser is in said upper position, said plates are in an inclined position, and when said riser is in said lower position, said plates are in a generally horizontal position;

means associated with at least some of said elongated plates serving as a visual indicator of fairway distance; and skirt means associated with said base support means and extending outwardly therefrom a predetermined distance to keep grass from growing too near the marker, said skirt means being in the form of an annular ring having a recessed inner periphery for receiving the outer periphery of said base support means.

2. An improved golf fairway distance marker as recited in claim 1 wherein said base support means comprises:

a circular plate; and a clamp ring affixed to said circular plate and combining therewith to form a first annular recess for receiving said one extremity of each said elongated plate.

3. An improved golf fairway distance marker as recited in claim 2 wherein said riser is resiliently supported above the center of said circular plate and includes a second annular recess formed therein for pivotally receiving said opposite extremity of each said elongated plate.

4. An improved golf fairway distance marker as recited in claim 1 wherein said anchor means is comprised of a cylinder with sharpened edges at one end to facilitate driving said cylinder into the ground.

5. An improved golf fairway distance marker as recited in claim 1 wherein said fastening means is comprised of:

latch means;

means for attaching said latch means to said anchor means; and means for attaching said latch means to said base support means.

6. An improved golf fairway distance marker as recited in claim 5 wherein said latch means is comprised of a block with a laterally extending peg adapted to pass through fastener holes provided in said anchor means, one surface thereof being adapted to engage said base support means and be attached thereto with screws.

7. An improved golf fairway distance marker as recited in claim 1 wherein said means forming said central riser comprises:

housing means affixed to said base support means and forming a chamber which is open at its top;

plunger means telescopically movable within said chamber between an upper position and a lower position, said plunger means having an annular recess formed therein for receiving said opposite extremities of said elongated plates; and spring means disposed within said chamber for resiliently biasing said plunger means toward said upper position.

8. An improved golf fairway distance marker as recited in claim 3 wherein each said elongated plate is generally trapezoidal in shape with the narrower parallel edge of said elongated plate disposed within said second annular recess and with the wider parallel edge of said elongated plate disposed within said first annular recess.

9. An improved golf fairway distance marker as recited in claim 8 wherein said narrower parallel edge of each said elongated plate is down-turned and mated with an up-turned surface in part forming said second annular recess, and wherein such mating prevents said plate means from disengaging from said plunger means when said plunger means is in its upper position.

10. An improved golf fairway distance marker as recited in claim 8 wherein said wider parallel edge of each said elongated plate is up-turned and mated with a down-turned surface in part forming said first annular recess, and wherein such mating allows each said elongated plate to rotate between a raised position and a lowered position without disengaging said first annular recess.

11. An improved golf fairway distance marker as recited in claim 8 wherein each said elongated plate includes an overlapping edge portion formed on one non-parallel edge and a relief ledge formed in the other non-parallel edge, such that the edge portion of each said plate will overlap the relief ledge of an adjacent plate.

12. An improved golf fairway distance marker as recited in claim 8 wherein each said elongated plate includes a relief ledge formed in said narrower parallel edge, such that said relief ledge will slide into said second annular recess.

13. In a golf fairway yardage marking system including a plurality of yardage markers disposed at predetermined intervals along the approach to a fairway's associated green, an improved yardage marker comprising:

anchor means;

base support means including a circular plate, and a ring affixed to said plate and combining therewith to form a first annular recess;

fastening means for securing said anchor means to said base support means;

means forming a central riser disposed in the center of said base support means and above said circular plate, said riser having a second annular recess formed therein, said riser being movable between an upper position and a lower position and including means supporting and resiliently biasing said riser in the direction toward the upper position;

a plurality of elongated plates each having one extremity pivotally engaging said base support means and an opposite extremity pivotally engaging said central riser, such that, when said riser is in said upper position, said plates are in an inclined position, and when said riser is in said lower position, said plates are in a generally horizontal position, each said elongated plate being generally trapezoidal in shape with the narrower parallel edge thereof forming said second extremity being pivotally disposed within said first annular recess and with the wider parallel edge thereof being pivotally disposed within said second annular recess, adjacent pairs of said plates being disposed relative to each other such that a clearance gap exists between them in the area generally proximate the narrower parallel edge of each said plate, but such that substantially no clearance gap exists between said adjacent plates in the area generally proximate to the wider parallel edge of said plate;

means associated with at least some of said elongated plates serving as a visual indicator of fairway distance; and skirt means associated with said base support means and extending outwardly therefrom a predetermined distance to keep grass from growing too near the marker, said skirt means being in the form of an annular ring having a recessed inner periphery for receiving the outer periphery of said base support means.

14. In a golf fairway yardage marking system as recited in claim 13 wherein said anchor means is comprised of a cylinder with sharpened edges at one end to facilitate driving said cylinder into the ground.

15. In a golf fairway yardage marking system as recited in claim 13 wherein said fastening means is comprised of:

latch means;

means for attaching said latch means to said anchor means; and means for attaching said latch means to said base support means.

16. In a golf fairway yardage marking system as recited in claim 15 wherein said latch means is comprised of a block with a laterally extending peg adapted to pass through fastener holes provided in said anchor means, one surface thereof being adapted to engage said base support means and be attached thereto with screws.

17. In a golf fairway yardage marking system as recited in claim 13 wherein said means forming said central riser comprises:

housing means affixed to said base support means and forming a chamber which is open at its top;

plunger means telescopically movable within said chamber between an upper position and a lower position, said plunger means having an annular recess formed therein for receiving said opposite extremities of said elongated plates; and spring means disposed within said chamber for resiliently biasing said plunger means toward said upper position.

18. In a golf fairway yardage marking system as recited in claim 13 wherein each said elongated plate is generally trapezoidal in shape with the narrower parallel edge of said elongated plate disposed within said second annular recess and with the wider parallel edge of said elongated plate disposed within said first annular recess.

19. In a golf fairway yardage marking system as recited in claim 18 wherein said narrower parallel edge of each said elongated plate is down-turned and mated with an up-turned surface in part forming said second annular recess, and wherein such mating prevents said plate from disengaging from said plunger means when said plunger means is in its upper position.

20. In a golf fairway yardage marking system as recited in claim 18 wherein said wider parallel edge of each said elongated plate is up-turned and mated with a down-turned surface in part forming said first annular recess, and wherein such mating allows each said elongated plate to rotate between a raised position and a lowered position without disengaging said first annular recess.

21. In a golf fairway yardage marking system as recited in claim 18 wherein each said elongated plate includes an overlapping edge portion formed on one non-parallel edge and a relief ledge formed in the other non-parallel edge, such that the edge portion of each said plate means will overlap the relief ledge of an adjacent plate.

22. In a golf fairway yardage marking system as recited in claim 18 wherein each said elongated plate includes a relief ledge formed in said narrower parallel edge, such that said relief ledge will slide into said second annular recess.

* * * * *